US005324210A

United States Patent [19]

Brickley

[11] Patent Number: 5,324,210

[45] Date of Patent: Jun. 28, 1994

[54] LATCH MECHANISM

[76] Inventor: Roger J. Brickley, 602 Oliver St., Marion, S.C. 29571

[21] Appl. No.: 11,138

[22] Filed: Jan. 29, 1993

[51] Int. Cl.[5] ..... H01R 13/62

[52] U.S. Cl. ..... 439/372; 439/347; 439/358

[58] Field of Search ..... 439/345, 347, 350, 352, 439/353, 358, 354, 357, 372

[56] References Cited

U.S. PATENT DOCUMENTS

| | | | |
|---|---|---|---|
| 644,144 | 12/1900 | Gerhardt . | |
| 1,899,360 | 2/1933 | Roudebush et al. . | |
| 3,777,298 | 12/1973 | Newmann . | |
| 3,824,522 | 7/1974 | Bertrams et al. . | |
| 4,245,879 | 1/1981 | Buck . | |
| 4,268,729 | 5/1981 | Gaizauskas . | |
| 4,280,746 | 7/1981 | Ignatowicz . | |
| 4,500,154 | 2/1985 | Collins . | |
| 4,544,225 | 10/1985 | Raus et al. . | |
| 4,838,808 | 6/1989 | Fujiura | 439/352 X |
| 4,875,874 | 10/1989 | Windsor, Jr. . | |
| 4,892,490 | 1/1990 | Tsuchiya et al. . | |
| 4,998,884 | 3/1991 | Ishikawa et al. | 439/372 X |
| 5,017,149 | 5/1991 | Hatanaka . | |
| 5,044,977 | 9/1991 | Vindigni . | |
| 5,125,850 | 6/1992 | Locati . | |

*Primary Examiner*—Larry I. Schwartz
*Assistant Examiner*—Khiem Nguyen
*Attorney, Agent, or Firm*—Richard H. Kosakowski

[57] ABSTRACT

An improved latch mechanism is disclosed for securing a multiple-wire connector to a corresponding multiple-wire receiver affixed to a chassis of an electronic apparatus such as a personal computer. The latch mechanism includes first and second pivotable clips affixed to opposed mounting sides of the connector, and an actuating bar interconnecting the clips. Each clip includes a pivot plate having a finger end and a pivotally opposed clasp end, arranged so that depression of the finger end toward the connector moves the clasp end to an open position away from the connector. A pivot spring biases each pivot plate toward the connector. The actuating rod extends from the finger end of a pivot plate of one clip, to the clasp end of the pivot plate of the opposed clip, so that depression of either finger end to which the actuating rod is affixed causes both clasp ends of the pivot plates to move away from the connector to their open positions. Consequently, a user of this latch mechanism need only depress the finger end of either clip to place the clasp ends of both clips in an open position, so the clasp ends can detachably engage the receiver.

8 Claims, 3 Drawing Sheets

LATCH MECHANISM

BACKGROUND OF THE INVENTION

The present invention relates to latches for securing electrical wire connectors to receivers. In particular, an improved latch mechanism is disclosed for securing a multiple-wire connector to a corresponding receiver on an electronic apparatus, such as a personal computer ("PC").

It is well known to utilize multiple-wire connectors to interconnect a variety of common electronic components. For example, an ordinary office PC typically includes a plurality of multiple-wire receivers. Each receiver is "hard-mounted" on the back of the PC chassis, and each receiver is specifically adapted to secure multiple-wire connectors from other electronic components, such as a keyboard, monitor, printer or modem.

To prevent accidental disconnection of such connectors from their respective receivers, it has become common to utilize latch mechanisms to secure a connector to its receiver. Several types of known latches are finger manipulated, while other types require use of hand tools. The finger or digitally manipulable latches are typically affixed to mounting flanges on opposed sides of the connector, and are adapted to engage latch blocks or posts on the corresponding receivers. An example of a well-known, common connector utilizing digitally manipulated latch mechanisms is commonly referred to as a "D subminiature" connector. Such connectors frequently have latches that include opposed, spring-biased clips, or sliding clips that engage latch blocks on receivers. Other known latches utilize jackscrews or thumbscrews on opposed sides of connectors, while additional latches utilize "bail locks", wherein mating clasps are deformed to secure the connector to its receiver.

While known latches effectively prevent accidental disconnection of multiple-wire connectors from receivers, they all suffer from inherent, structural limitations. All of the digitally manipulable latches require either simultaneous use of two fingers from opposed sides of the latch, or they require use of one finger, from only one side of the latch. Consequently, such finger-operated latches are often difficult to fully open or close in cramped locations, such as the typical "close quarters" between the back of a PC and a nearby office wall. Similarly, latches utilizing thumbscrews or jackscrews, or special mounting tools, also require access to both opposed sides of the latch for proper usage. Therefore, not only do they require additional costs in time and labor during use of the tools, but, like digitally manipulable latches, they also require simultaneous access to both sides, thereby limiting effective use of the latches in cramped locations.

Accordingly, it is the general object of the present invention to provide an improved latch mechanism that overcomes the problems of the prior art.

It is a more specific object to provide an improved latch mechanism that secures a multiple-wire connector to a receiver without utilizing special tools.

It is another specific object to provide a latch mechanism that can be retrofitted onto known multiple-wire connectors.

It is yet another specific object to provide a digitally manipulable latch mechanism that can secure a multiple-wire connector to a receiver through use of one finger from either of two opposed sides of the connector.

The above and other objects and advantages of this invention will become more readily apparent when the following description is read in conjunction with the accompanying drawings.

SUMMARY OF THE INVENTION

An improved latch mechanism is disclosed for securing a multiple-wire connector to a corresponding multiple-wire receiver affixed to a chassis of an electronic apparatus. In a preferred embodiment, the invention comprises a pair of spring-biased, pivotable clips secured to opposed sides of the connector; and an actuating rod interconnecting the clips.

In use, the pivotable clips are first secured to a mounting flange, which extends beyond opposed sides of the connector. The actuating rod is then secured between a finger end on one clip and a clasp end on the opposed clip. The clips are adapted to pivot about respective pivot points between their respective finger and clasp ends, so that depression toward the connector of a finger end on a first clip causes the clasp end on that clip to pivot away from the connector, in an open position. In the same manner, depression of a finger end to which the actuating rod is affixed causes the clasp end of the opposed clip, that is interconnected by the actuating rod, to move also to an open position, away from the connector. Springs within each clip bias the clasp ends toward the connector in a closed position.

Consequently, a user need only depress the finger end of either clip (with finger pressure) to move the clasp ends of both clips away from the connector to the open position. The connector can then be easily inserted onto a corresponding receiver. As the user releases his finger pressure, the springs move the clasp ends of both clips back toward the connector, so that clasps on each clip engage latch blocks on the receiver, thereby securing the connector from accidental disconnection from the receiver. To quickly disconnect the connector, the user only has to depress the finger end of either clip to again move the clasp ends of both clips, and thereby disengage the clasps, and allow removal of the connector from the receiver.

DETAILED DESCRIPTION OF THE PREFERRED EMBODIMENTS

Figure 1:
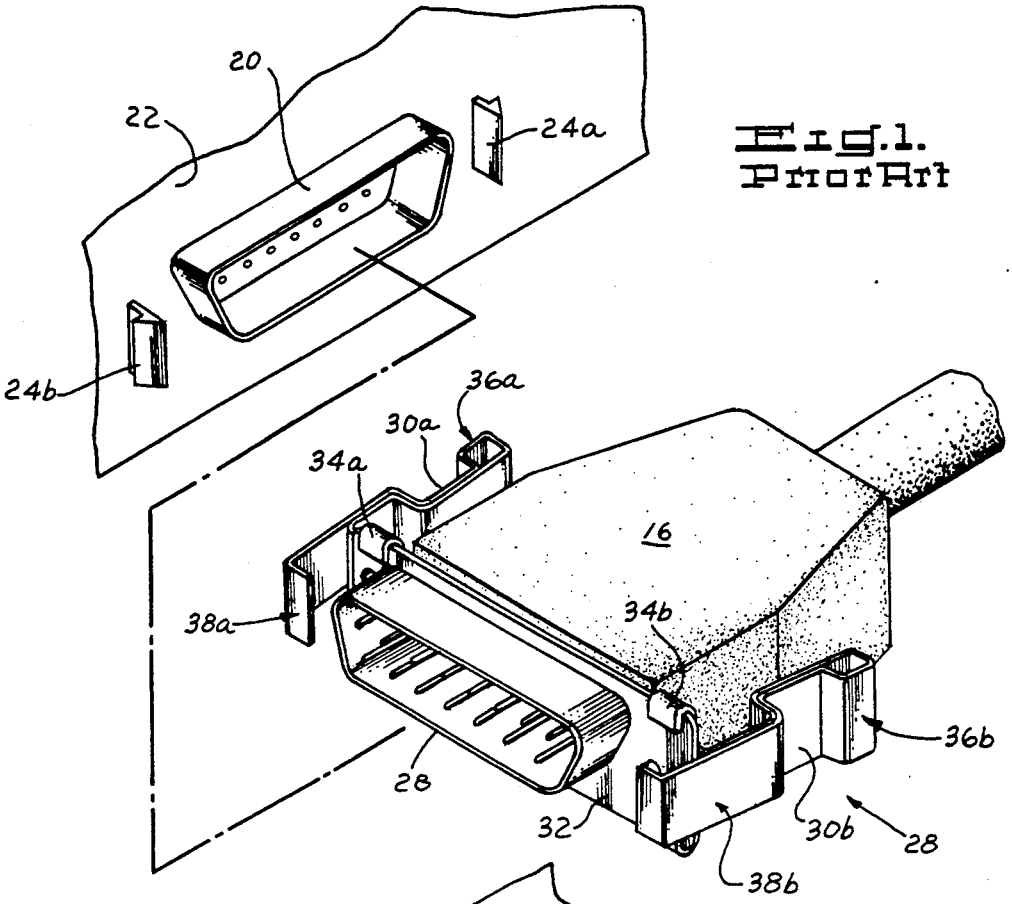
Fig.1. Prior Art
FIG. 1 is a perspective view (labeled "PRIOR ART") of a multiple-wire connector and corresponding receiver, showing a conventional mechanism affixed to the connector.
Figure 2:
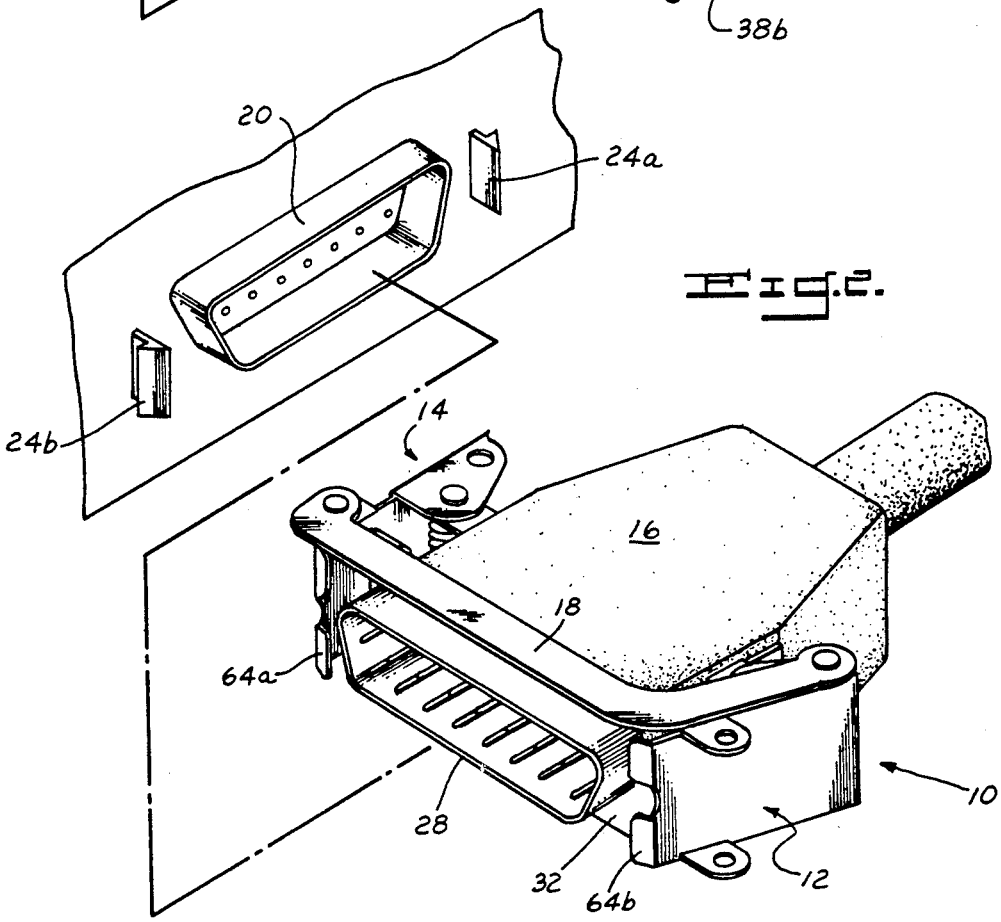
FIG. 2 i a similar perspective view of the multiple-wire connector of 1, showing affixed thereto an improved latch mechanism constructed in accordance with the present invention.

Referring to the drawings in detail, the preferred embodiment of an improved latch mechanism of the present invention is shown in FIGS. 2–8, and generally designated by the numeral 10. The illustrated latch mechanism 10 basically comprises a first pivotable clip 12 and a virtually identical second pivotable clip 14, that are adapted to be secured in opposed relation on a multiple-wire connector 16; and an actuating rod 18 interconnecting the first and second clips 12, 14. It is presently being marketed under the trademark UNI-LATCH TM by UNISEM Corporation of Mullins, South Carolina.

As best shown in FIG. 1, a common multiple-wire receiver 20 is securely affixed, or "hard-mounted", to a chassis 22 of an electronic apparatus (e.g., a PC). The receiver 20, known in the prior art, includes a pair of opposed latch-block means, or barbed latch blocks, 24*a*, 24*b*, adapted to secure any suitable latch mechanism. Also seen in FIG. 1 is a common multiple-wire connector 16 with an affixed conventional latch 28. This prior latch 28 includes virtually identical opposed clamps 30*a*, 30*b*, secured to a mounting flange 32 of the connector 16 by "C"-shaped locks 34*a*, 34*b*. These prior-art clamps 30*a*, 30*b* are adapted to bend upon simultaneous depression of nearby finger points 36*a*, 36*b*, so that clasps 38*a*, 38*b* move away from the connector 16, to an open position. The clasps 38*a*, 38*b* are then jointly held in the open position while the connector 16 is mounted onto the receiver 20. When pressure is let off the finger points 36*a*, 36*b*, the prior-art clasps 38*a*, 38*b* move back toward the connector 16 in a closed position, to clasp or latch onto the latch blocks 24*a*, 24*b*. This secures the connector 16 to the receiver 20, and prevents accidental disconnection. Depression of the prior-art finger points 36*a*, 36*b*, to place the clasps 38*a*, 38*b* in an open position, permits disengagement of the connector 16 from the receiver 20, when desired.

As best seen in FIGS. 2–6, the improved latch mechanism 10 of the present invention can also be secured to the mounting flange 32 of the connector 16, by first and second clip means or pivotable clips 12, 14. Each clip includes a base plate 44*a*, 44*b* adapted to abut opposed first and second mounting sides of the connector 16; and a pivot plate 48*a*, 48*b* pivotally secured to each base plate 44*a*, 44*b*. Identical wing locks (or spring hooks) 50*a*, 50*b* are affixed to lock ends 52*a*, 52*b* of the base plates 44*a*, 44*b*. These spring hooks are adapted to lock the base plate onto opposed first and second ends of the connector's mounting flange 32. Though not shown, the hooks lock onto base plate 32 near where the prior-art clips 34*a*, 34*b* are illustrated in FIG. 1.

Figure 3:
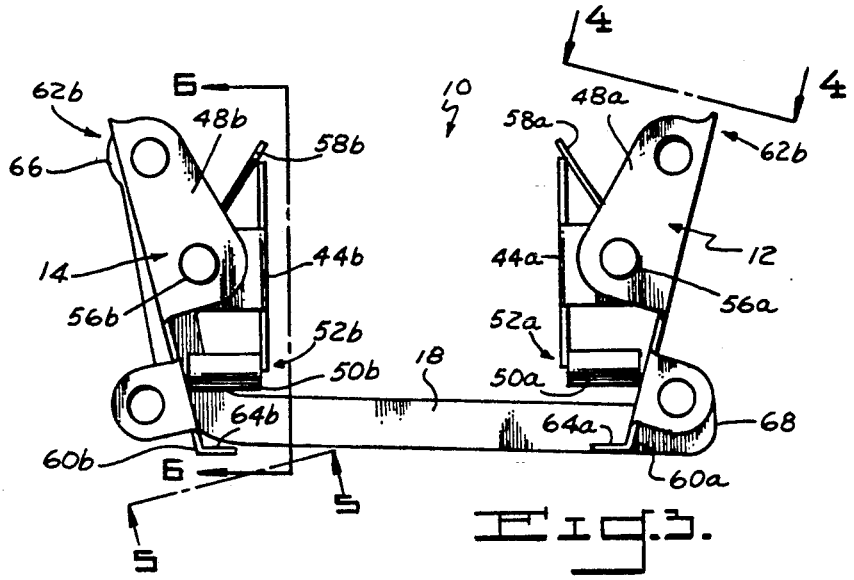
FIG. 3 is a rear plan view of the improved latch mechanism of the present invention (with the connector removed for clarity)
Figure 4:
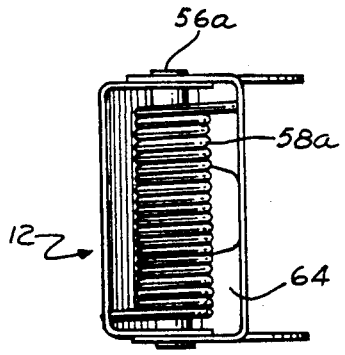
FIG. 4 is a top view of one of the improved latch mechanism's two identical clips, taken along line 4—4 of FIG. 3.
Figure 5:
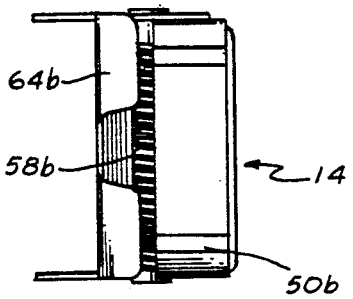
FIG. 5 is a bottom view of the other clip, taken along line 5—5 of FIG. it in a partially opened position.
Figure 6:
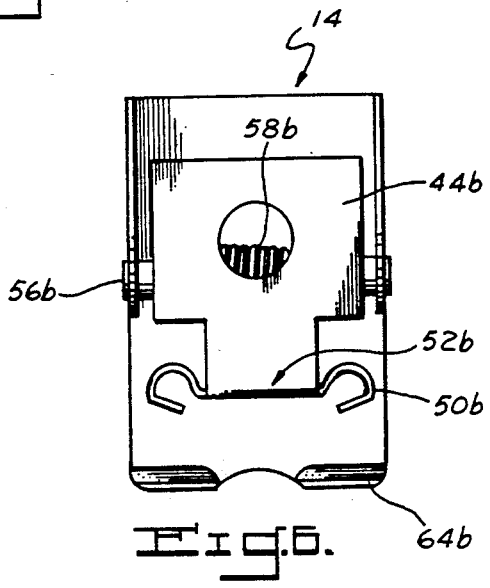
FIG. 6 is a side view of the clip of FIG. 5, taken along line 6–6 of FIG. 3.
Figure 7:
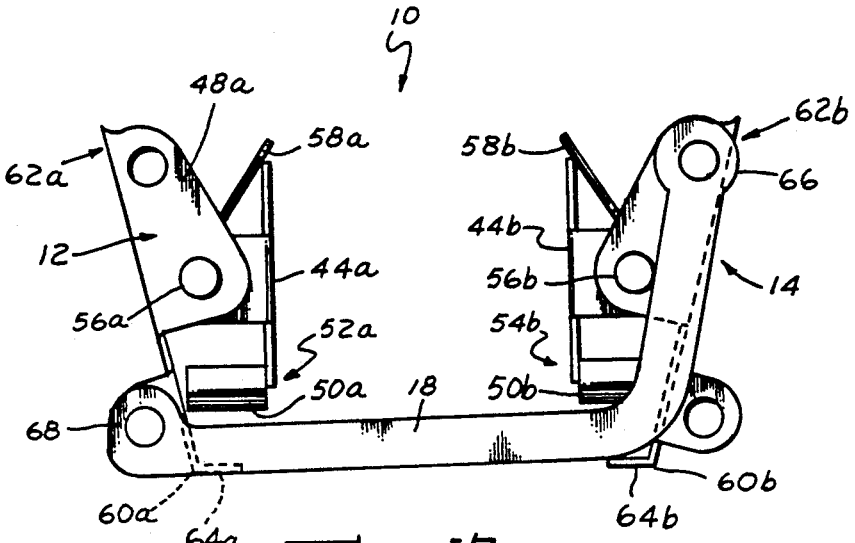
FIG. 7 is a front plan view of the improved latch mechanism showing its clips in their closed positions.
Figure 8:
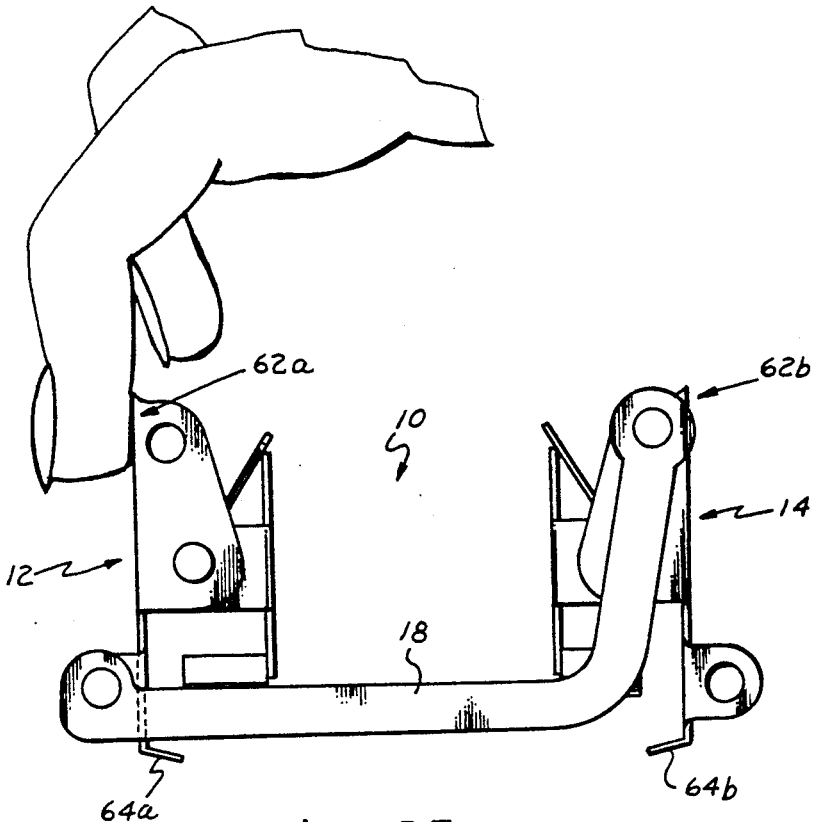
FIG. 8 is a view similar to FIG. 7, but with the clips being biased to their opened positions.

As seen best in FIGS. 3, 7 and 8, pivot axles 56*a*, 56*b* are mounted within each base plate 44*a*, 44*b*, and are adapted to secure pivot spring means of pivot springs 58*a*, 58*b*. Pivot plates 48*a*, 48*b* are pivotally affixed to a corresponding base plate 44*a*, 44*b*, via the pivot axles 56*a*, 56*b*, and are biased by pivot springs 58*a*, 58*b* to fixed closed positions with respect to the corresponding base plate 44*a*, 44*b*. In the closed positions (see FIGS. 3 and 8), clasp ends 60*a*, 60*b* of each pivot plate 48*a*, 48*b* are biased toward the lock ends 52*a*, 52*b* of the corresponding base plates 44*a*, 44*b*; and finger ends 62*a*, 62*b*, opposed to clasp ends 60*a*, 60*b* of the pivot plates 48*a*, 48*b*, are biased away from the corresponding base plates 44a, 44b. Each pivot plate 48*a*, 48*b* also includes clasps 64*a*, 64*b* adjacent the clasp ends 60*a*, 60*b*, adapted to engage the unshown undersides of latch blocks 24*a*, 24*b*, in order to secure the connector 16 to the receiver 20.

As shown in FIGS. 2, 3, 7 and 8, an actuating means or actuating rod 18 interconnects the first and second pivotable clips 12, 14, and includes a finger coupling end 66 and an opposed clasp coupling end 68. In the preferred embodiment, the actuating rod is substantially L-shaped. The rod's finger coupling end 66 is pivotally secured to the finger end 62*b* of the pivot plate 48*b* of the second pivotable clip 14, and the clasp coupling end 68 of the rod 18 is pivotally secured to the clasp end 60*a* of the pivot plate 48*a* of the first pivotable clip 12. Consequently, depression toward the connector 16 of the finger end 62*b* of the pivot plate 48*b* of the second pivotable clip 14 also moves the finger coupling end 66 of the actuating rod 18 toward the connector 16. The clasp coupling end 68 of the rod 18, in turn, moves the affixed clasp end 60*a* of the pivot plate 48*a* of the first pivotable clip 12 away from the connector 16, thereby placing both clasps 64*a*, 64*b* in open positions, away from the connector (see FIG. 8). As is apparent from FIGS. 2–8, the same effect is achieved where actuating rod 18 is positioned in an opposite disposition to that first described above, so that the rod's finger coupling end 66 is affixed to the finger end 62*a* of the pivot plate 48*a* on the first pivotable clip 12, while the rod's clasp coupling end 68 is affixed to the clasp end 60*b* of the pivot plate 48*b* of the second pivotable clip 14.

In using the improved latch mechanism 10 of the present invention to secure a connector 16 to a receiver 20, depression toward the connector 16 of either finger end 62*a*, 62*b* of pivotable clips 12, 14 puts both clasps 64*a*, 64*b* in an open position so that the connector 16 can be placed onto the receiver 20. The pivot springs 58*a*, 58*b* then bias the finger ends 62*a*, 62*b* of both pivot plates 48*a* , 48*b* away from the connector 16 so that both clasps 64*a*, 64*b* pivot toward the connector 16 to contact the securing surfaces 40*a*, 40*b* of latch blocks 24*a*, 24*b* of the receiver 20, thereby securing the connector 16 against accidental disconnection from the receiver 20. To remove the connector, either finger end 62*a*, 62*b* is simply depressed (see FIG. 8), thereby disengaging clasps 64*a*, 64*b* from latch blocks 24*a*, 24*b* so that the connector 16 can be removed from the receiver 20.

It should be understood by those skilled in the art that obvious structural modifications can be made without departing from the spirit of the invention. For example, the clips need not be identical, unless interchangeability is desired. Accordingly, reference should be made to the accompanying claims rather than the foregoing specification to determine the scope of the invention.

Having thus described the invention, what is claimed is:

1. A latch mechanism for securing an electrical wire connector to a corresponding receiver, comprising:

a. first and second pivotable clip means affixed to opposed mounting sides of the electrical connector for detachably securing the electrical connector to the receiver; and b. actuating rod means secured to the first and second clip means for pivoting both clip means to an open position when either clip means is depressed toward the electrical connector, so that the first and second clip means detachably engages the receiver in the open position.

2. The latch mechanism of claim 1, wherein the first and second pivotable clip means comprises first and second pivotable clips, wherein each clip includes a finger end of a pivot plate pivotally opposed to a clasp end of the pivot plate, the pivot plate being adapted so that depression of the finger end of a pivot plate toward the electrical connector pivots the clasp end of a pivot plate away from the electrical connector.

3. The latch mechanism of claim 2, wherein the actuating rod means comprises an actuating rod having a finger coupling end affixed to a finger end of a pivot plate of either the first or second pivotable clip, and the rod having an opposed clasp coupling end affixed to the clasp end of the pivot plate of the opposed pivotable clip.

4. A latch mechanism for securing an electrical wire connector to a corresponding receiver comprising:

a. first and second pivotable clips affixed to opposed mounting sides of the electrical connector, wherein each of the clips includes a finger end of a pivot plate pivotally opposed to a clasp end of the pivot plate, the pivot plate being adapted so that the depression of the finger end of the pivot plate toward the electrical connector pivots a clasp affixed to the clasp end of the pivot plate away from the electrical connector; and b. an actuating rod having a finger coupling end affixed to a finger end of a pivot plate of either the first or second pivotable clip, and an opposed clasp coupling end of the rod affixed to the clasp end of the pivot plate of the opposed pivotable clip, adapted so that depression of a finger end of the pivot plate of either pivotable clip pivots the clasp ends of the pivot plate of both pivotable clips away from the electrical connector to an open position, wherein the clasps may detachably engage the receiver.

5. The latch mechanism of claim 4, wherein the pivot plates of each pivotable clip are adjustably secured to the opposed mounting sides of the electrical connector by pivot spring means for biasing the clasp ends of the pivot plates toward the electrical connector.

6. The latch mechanism of claim 5, wherein the pivot spring means includes:

a. a base plate adjacent the mounting side of the electrical connector;

b. a pivot axle secured to the base plate and the pivot plate at a point in the pivot plate between the finger end and clasp end of the pivot plate; and c. a pivot spring affixed to the pivot axle adapted to adjustable bias the clasp end of the pivot plate toward the electrical connector.

7. The latch mechanism of claim 6, wherein the electrical connector is a multiple-wire receiver secured to a chassis of an electronic apparatus.

8. In a latch mechanism for securing an electrical wire connector to a corresponding receiver of the type characterized by first and second pivotable clips secured to opposed mounting sides of the electrical connector, wherein each clip includes a finger end pivotally opposed to a clasp end, the finger and clasp ends adapted so that depression of the finger end toward the electrical connector pivots the clasp end away from the electrical connector to detachably engage the receiver, the improvement comprising an actuating rod having a finger coupling end affixed to a finger end of either the first or second pivotable clips, and the rod having an opposed clasp coupling end affixed to the clasp end of the opposed pivotable clip, so that depression of a finger end of either the first or second pivotable clip pivots the clasp ends of both first and second pivotable clips away from the electrical connector to an open position, to detachably engage the receiver.

* * * * *